US007284750B2

(12) United States Patent
Glowner

(10) Patent No.: US 7,284,750 B2
(45) Date of Patent: Oct. 23, 2007

(54) METHOD AND APPARATUS FOR HANDLING INSERTS FOR PRINTED MATERIALS

(76) Inventor: Dwayne Glowner, c/o Streamline Systems, 3293 Big Valley Dr., Lakeland, FL (US) 33813

( * ) Notice: Subject to any disclaimer, the term of this patent is extended or adjusted under 35 U.S.C. 154(b) by 0 days.

(21) Appl. No.: 10/967,789

(22) Filed: Oct. 18, 2004

(65) Prior Publication Data

US 2005/0116404 A1 Jun. 2, 2005

Related U.S. Application Data

(60) Provisional application No. 60/512,012, filed on Oct. 16, 2003.

(51) Int. Cl.
*B65H 39/00* (2006.01)

(52) U.S. Cl. ..... 270/52.14; 270/52.04; 270/52.05; 270/52.06; 270/52.19; 270/52.23; 270/52.24

(58) Field of Classification Search ..... 270/52.14, 270/52.19, 52.23, 52.04, 52.15, 52.05, 52.06, 270/52.24

See application file for complete search history.

(56) References Cited

U.S. PATENT DOCUMENTS

| | | | | |
|---|---|---|---|---|
| 3,122,362 | A * | 2/1964 | Vollrath et al. | 270/52.19 |
| 4,046,367 | A * | 9/1977 | Merker et al. | 270/52.24 |
| 4,925,173 | A * | 5/1990 | Lindblom et al. | 270/52.14 |
| 5,165,672 | A * | 11/1992 | Backman | 270/52.22 |
| 5,269,504 | A * | 12/1993 | Backman | 270/52.2 |
| 5,823,320 | A * | 10/1998 | Seidel et al. | 198/803.5 |
| 6,893,016 | B2 * | 5/2005 | Pav et al. | 271/270 |
| 6,907,316 | B2 * | 6/2005 | Bader et al. | 700/220 |

* cited by examiner

*Primary Examiner*—Gene O. Crawford
*Assistant Examiner*—Leslie A. Nicholson, III
(74) *Attorney, Agent, or Firm*—David E. Mikon; Bradley Arant Rose & White

(57) ABSTRACT

An apparatus for handling inserts for printed materials has been developed. The apparatus includes a printed material conveyor that includes a support post and a gripper. The conveyor receives and supports the printed material from below. After an insert has been placed inside the printed material, it is delivered to a stacker and jackets with insert errors are automatically returned to the conveyor.

10 Claims, 16 Drawing Sheets

METHOD AND APPARATUS FOR HANDLING INSERTS FOR PRINTED MATERIALS

CROSS-REFERENCE TO RELATED APPLICATIONS

This application claims priority from U.S. Provisional Patent Application 60/512,012 entitled "System and Apparatus for Handling Inserts for Printed Materials" that was filed on Oct. 16, 2003.

BACKGROUND OF INVENTION

The invention relates generally to printing machines. More specifically, the invention relates to a method and apparatus for handling inserts for printed materials.

BACKGROUND ART

Printed materials such as newspapers and tabloid style magazines often come with supplemental inserts. These inserts are typically additional advertisements, etc. that are added to the printed material after its printing. The addition of these inserts is done by a production process that automatically places the inserts inside the printed materials. However, it is common for errors to occur in the process due to misfeeds of the inserts resulting in printed materials with no inserts. These errors typically have to be corrected by manually removing them from the final product and re-feeding them at the beginning of the production process. This is a costly, time-consuming and inefficient method of correcting this problem. Consequently, a method of handling inserts for printed materials that automatically corrects errors is needed.

SUMMARY OF INVENTION

In some aspects, the invention relates to a method for adding inserts to printed material, comprising: receiving a jacket in a jacket conveyor, where the jacket conveyor comprises a gripper conveyor with a gripper, and a post conveyor with a support post; receiving an insert into the jacket from an insert feeder; delivering the jacket and insert to a product receiver; and returning a jacket with an insert error to the jacket conveyor for correction of the insert error.

In other aspects, the invention relates to an apparatus for adding inserts to printed material, comprising: a jacket feeder; a jacket conveyor that receives jackets from the jacket feeder, comprising, a gripper conveyor with a plurality of grippers, where the grippers support the jackets from the bottom, and a post support conveyor with a plurality of post supports; an insert feeder that feeds inserts into the jackets; and a product receiver that receives jackets with inserts from the jacket conveyor.

In other aspects, the invention relates to an apparatus for adding inserts to printed material, comprising: a jacket feeder; an insert feeder; a product receiver; means for receiving jackets from the jacket feeder in combination with inserts from the insert feeder and delivering the jackets with inserts to a product receiver; and means for automatically correcting jackets with insert errors.

Other aspects and advantages of the invention will be apparent from the following description and the appended claims.

BRIEF DESCRIPTION OF DRAWINGS

It should be noted that identical features in different drawings are shown with the same reference numeral.

DETAILED DESCRIPTION

The present invention involves a system and apparatus for handling inserts for printed materials such as advertising inserts for newspapers. FIGS. 1-11 show diagrams of the steps of a system for placing inserts in a newspaper in one example of the present invention. In this example, the newspapers or "jackets" are moved along the system by a jacket conveyor. The jacket conveyor includes three separate components that move in conjunction with each other: a gripper conveyor 10; a left post conveyor 12; and a right post conveyor 14.

Figure 1:
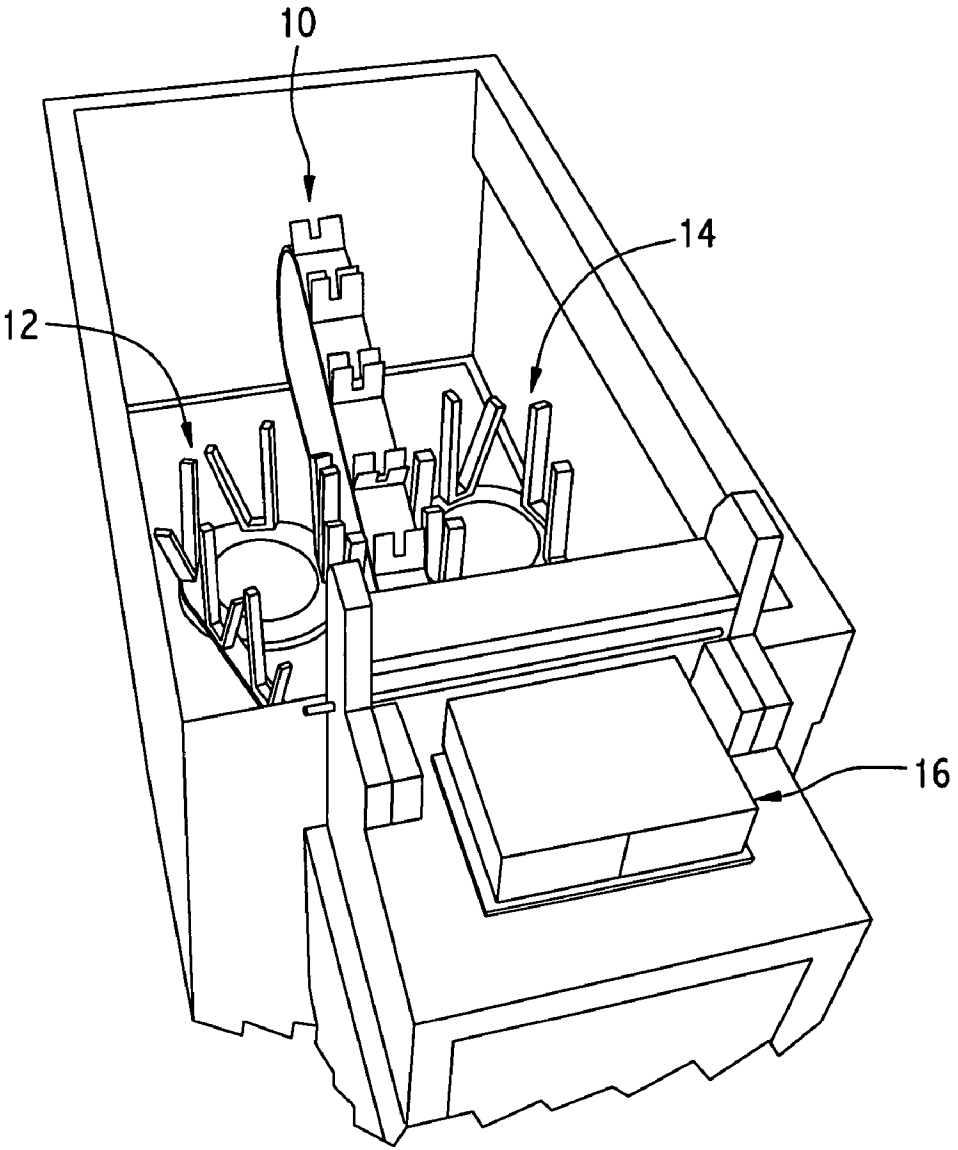
FIGS. 1-11 show diagrams of the steps of a method for placing inserts in a newspaper in accordance with one embodiment of the present invention.
Figure 2:
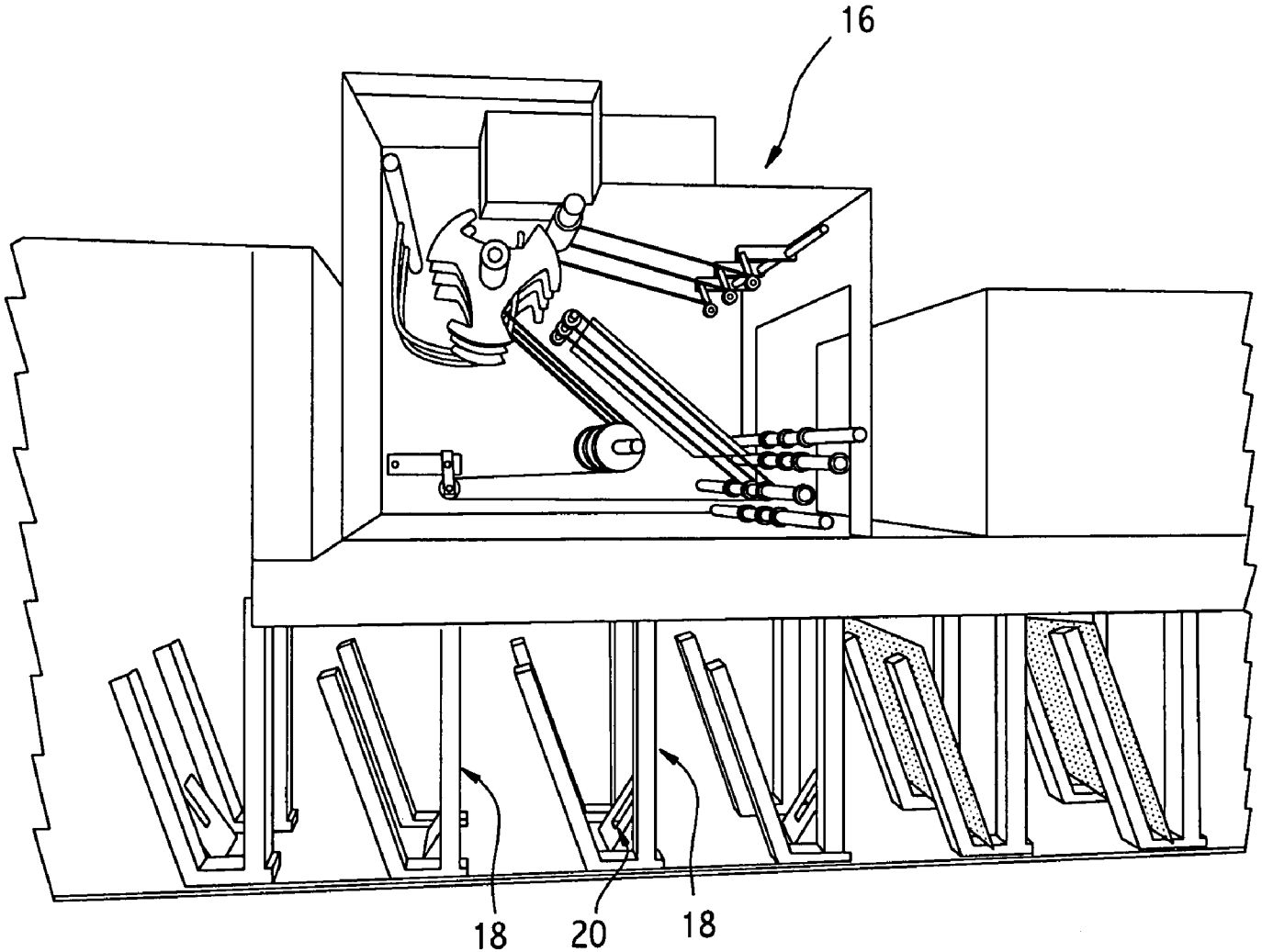
Figure 3:
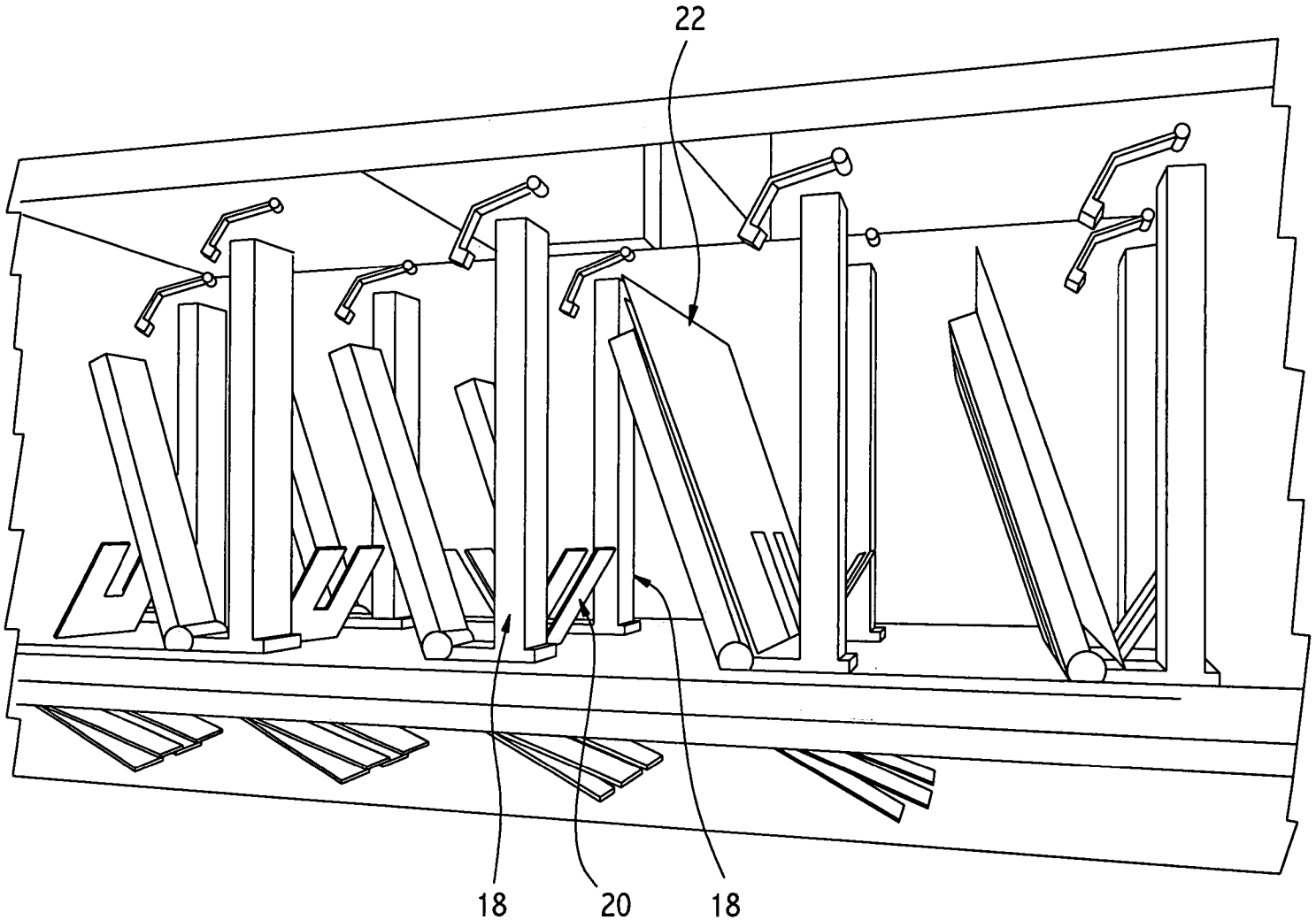

As shown in FIGS. 1, 2, and 3 the jacket conveyor passes underneath a high speed press feeder 16 that feed individual jackets into individual posts 18 and grippers 20. An individual post support 18 supports the jacket 22 in an upright position. It is formed by a left and right post on the post conveyors 12 and 14. A gripper 20 is located between the posts. These elements come together and work in conjunction as a jacket conveyor.

Figure 4:
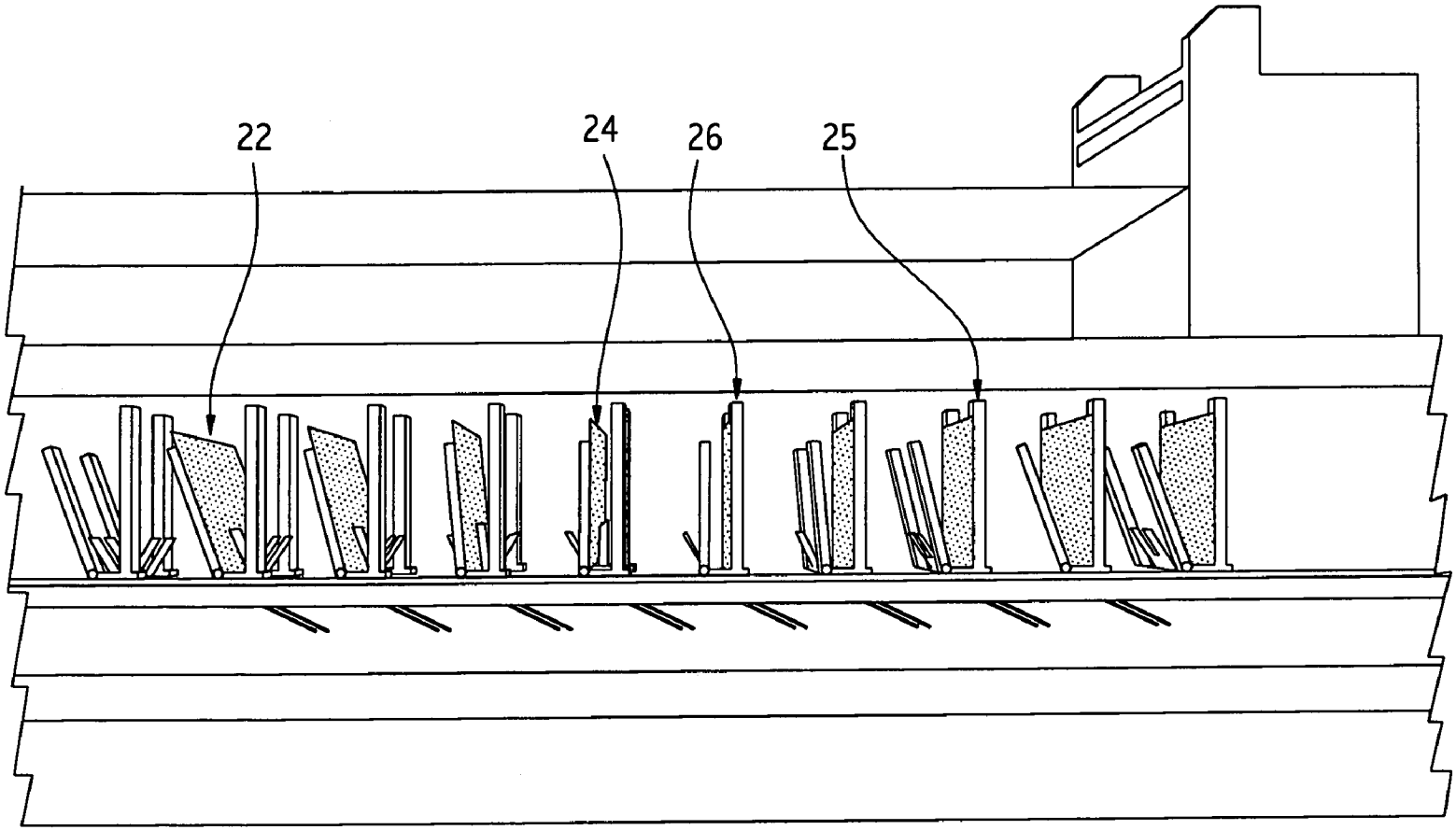
Figure 5:
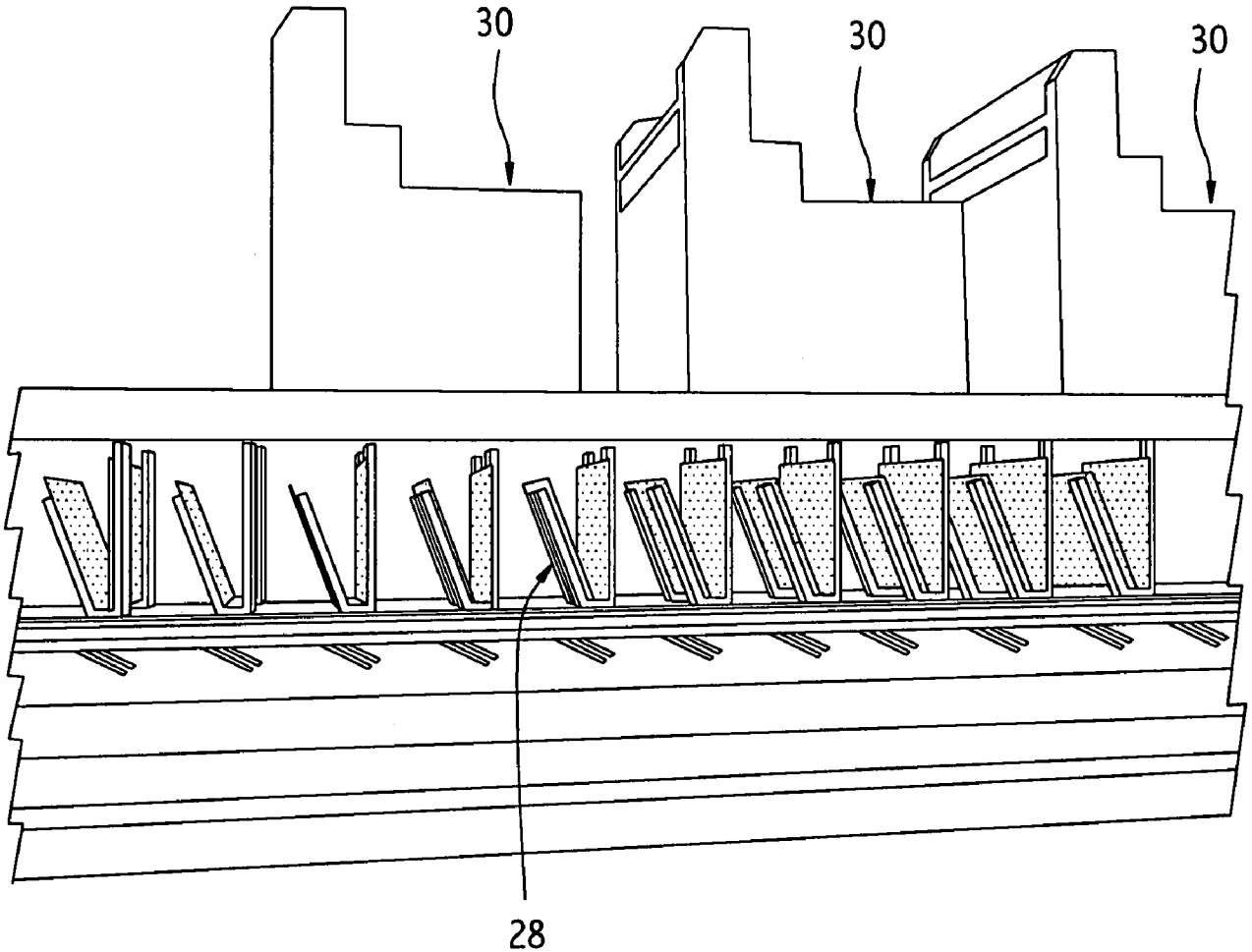

As shown in FIGS. 4 and 5, the jacket conveyor receives a closed jacket 24 from the high speed press feeder. The post support closes 26 and reopens 28 in order to open the jacket at its fold as the jacket conveyor moves along the production line. The jacket is held open by suction cups on the posts or any other suitable mechanism. The jacket conveyor then moves along underneath insert feeders 30 which feed inserts into the open jacket 28. In some embodiments, the distance between the jackets on the jacket conveyor is 6 inches. Locating the jackets closer to each other on the conveyor represents an improvement in the rate of production since more finished jackets can be produced in a shorter amount of time.

Figure 6:
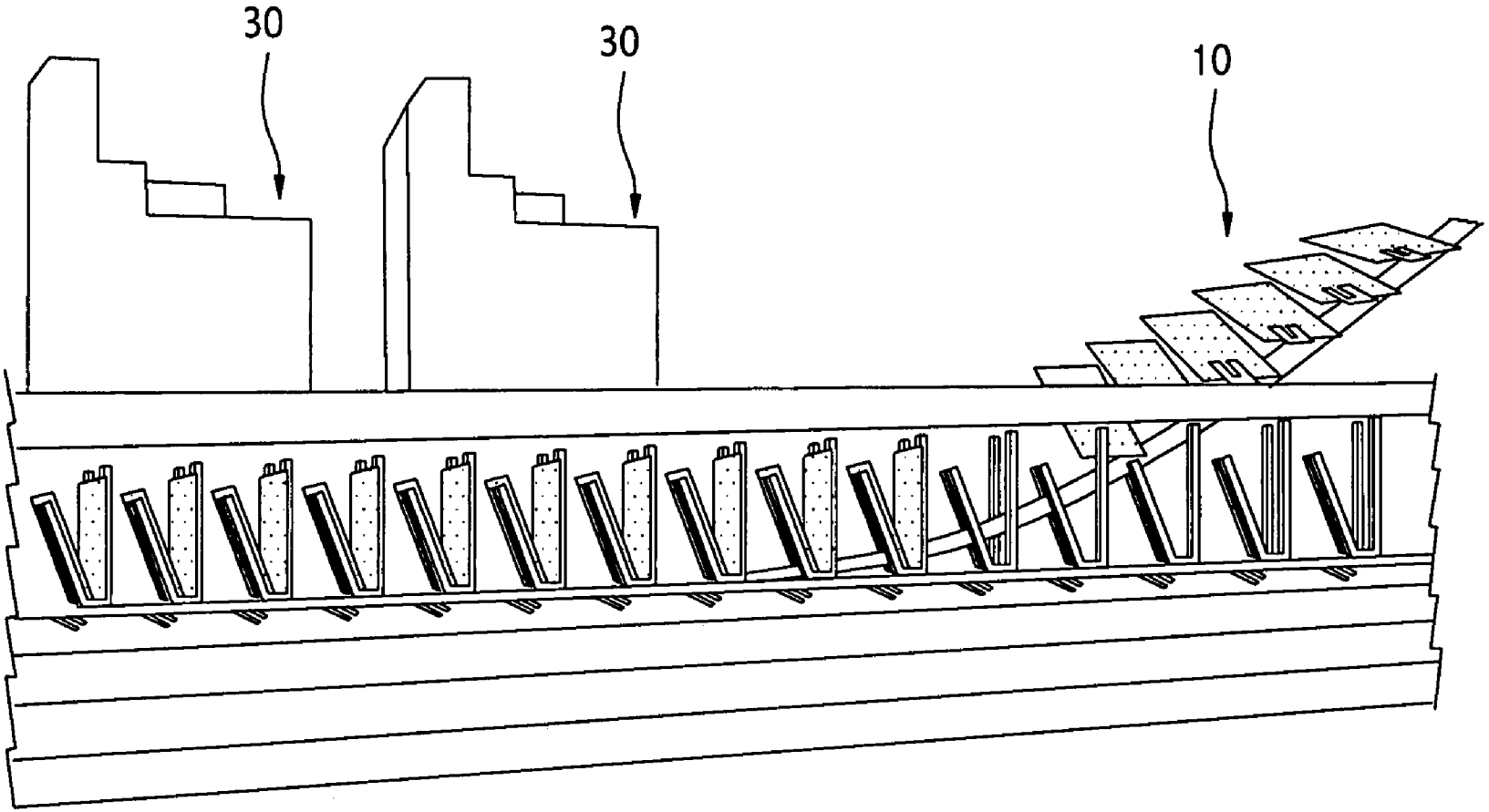
Figure 7:
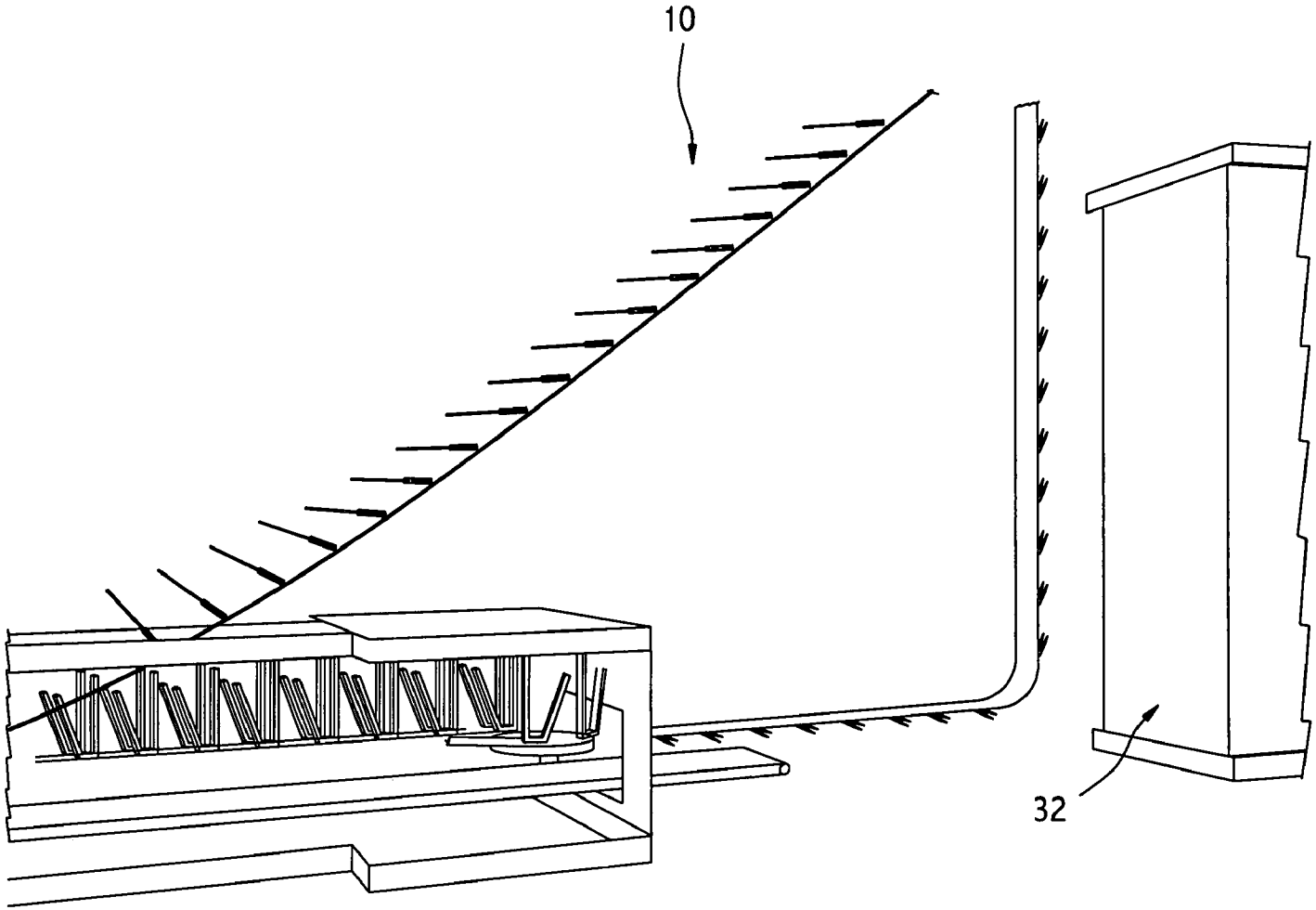
Figure 8:
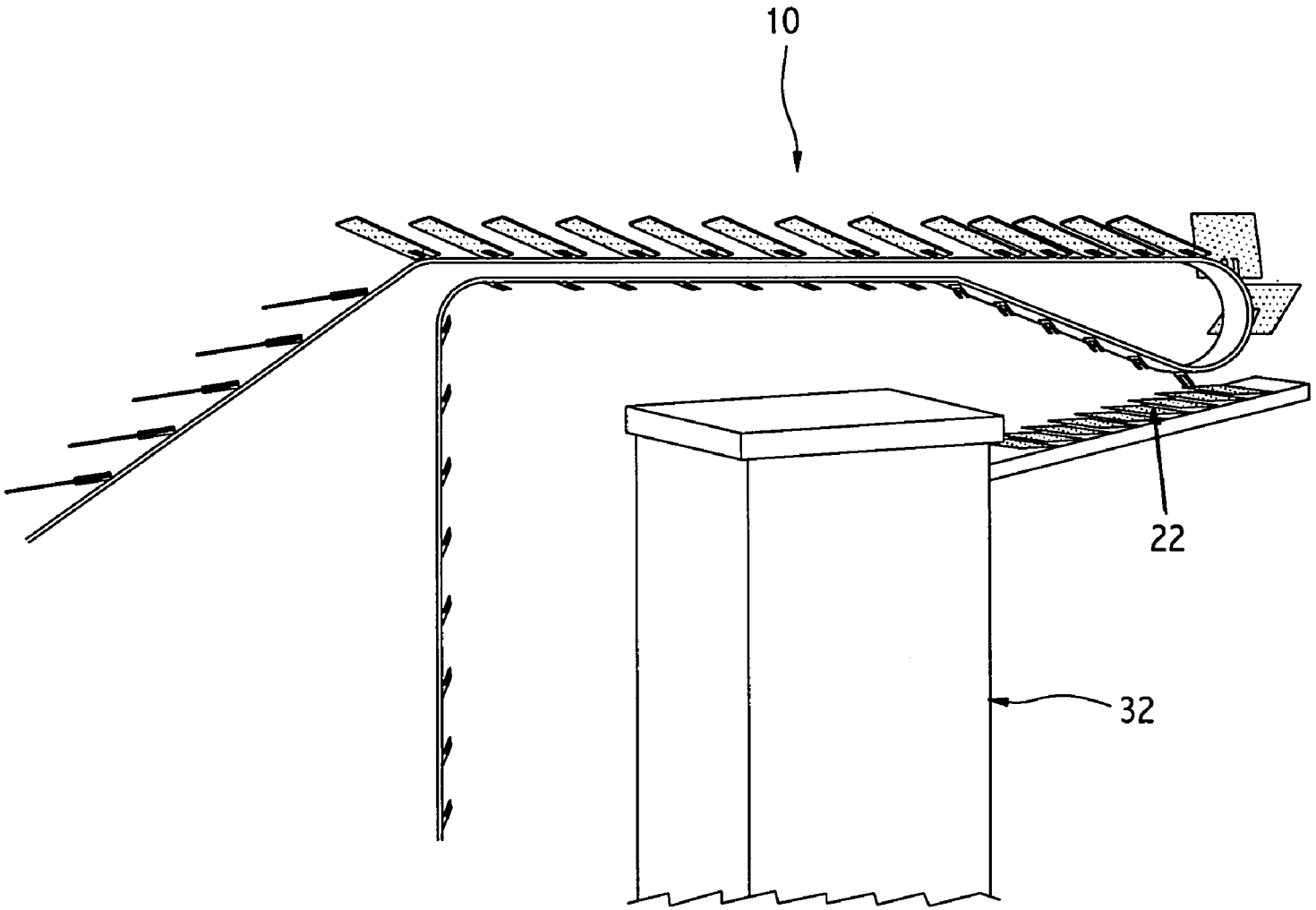

As shown in FIGS. 6-8, the gripper conveyor 10 separates from the rest of the jacket conveyor after passing the last insert feeder 30. The grippers 20 close the jacket and support it from the bottom. The gripper conveyor 10 moves the grippers 20 and the closed jackets along the line until the jackets 22 are released from the grippers and sent to a stacker 32 or other similar device that stacks or otherwise processes the jackets for shipping. It is important to note that the gripper conveyor 10 carries the jackets with inserts from below. This helps prevent inserts from falling out of the jacket during production.

Figure 9:
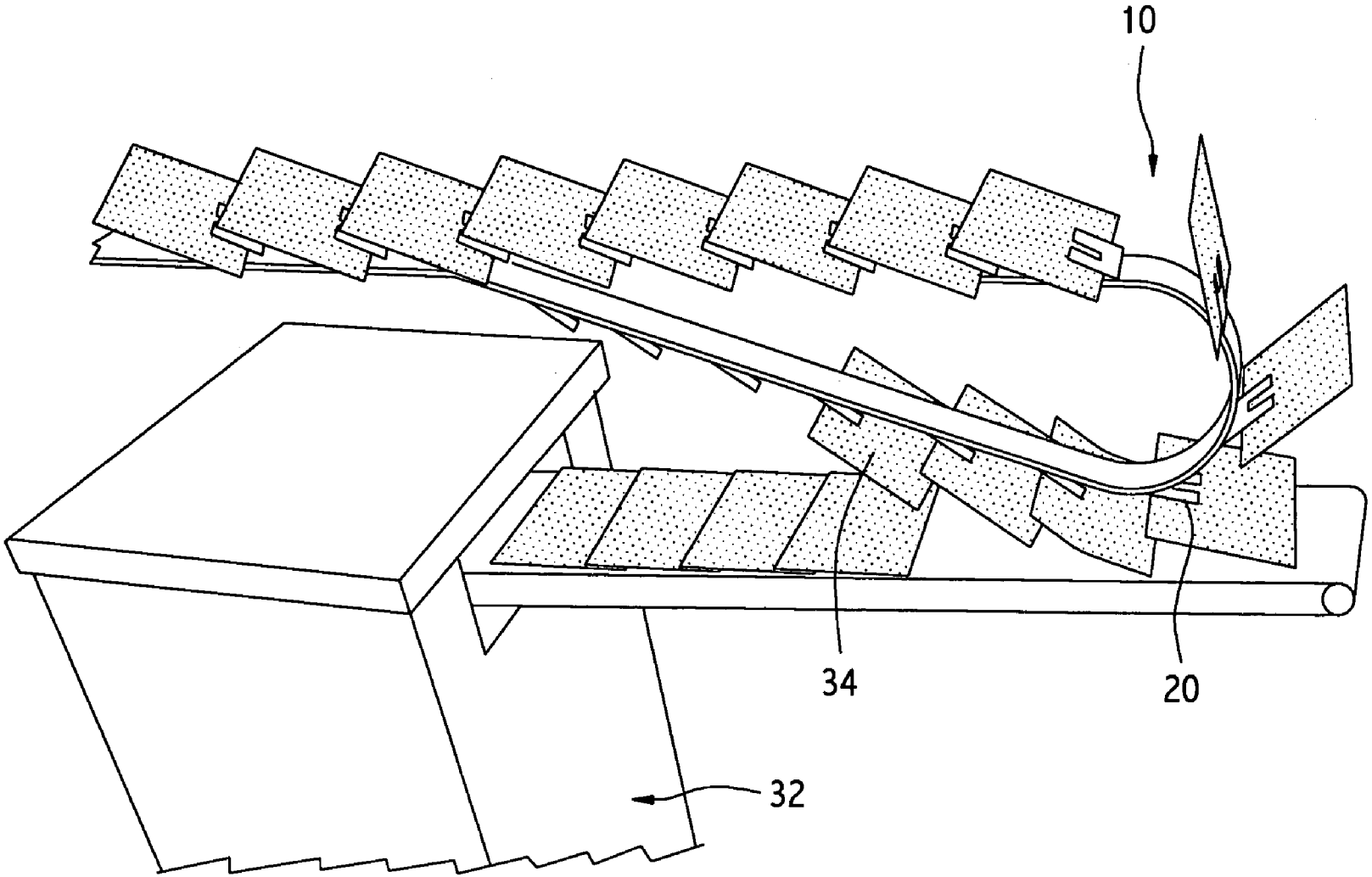
Figure 10:
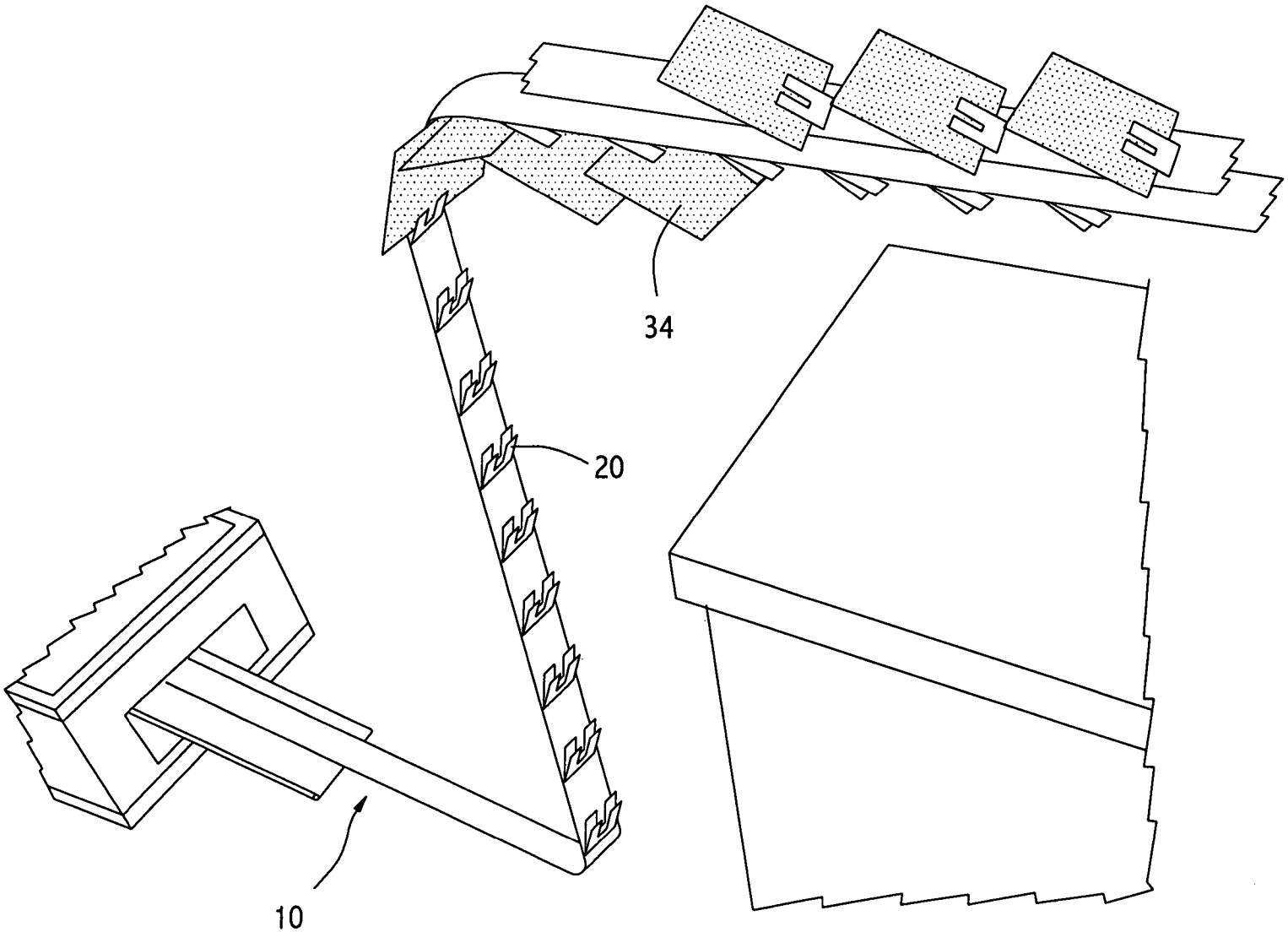
Figure 11:
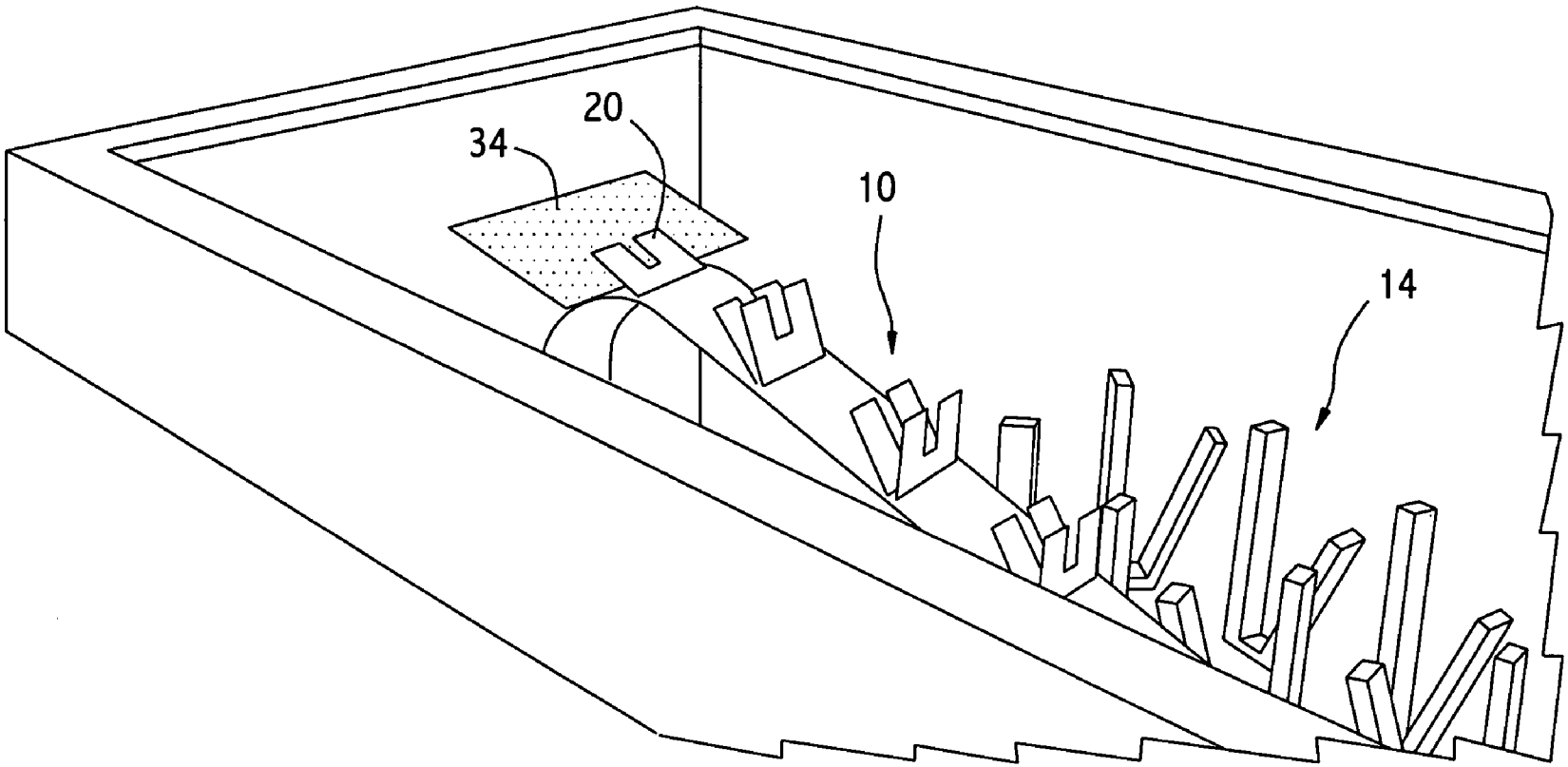

FIGS. 9-11, show the method of automatically correcting repairs to the jackets. If an error is detected, such as a missed insert in a jacket, the present invention may make automatic corrections to the jacket. A jacket with an error is called a "repair". In the present invention, the gripper 20 of a repair 34 may hold onto its jacket instead of releasing it to go to the stacker 32. The repair 34 is then returned along the gripper conveyor 10 to the front of the system where the gripper conveyor 10 meets up with the left and right post conveyors 12 and 14 to reform the jacket conveyor. The repair is then moved along the line a second time to receive its missed inserts.

Figure 12:
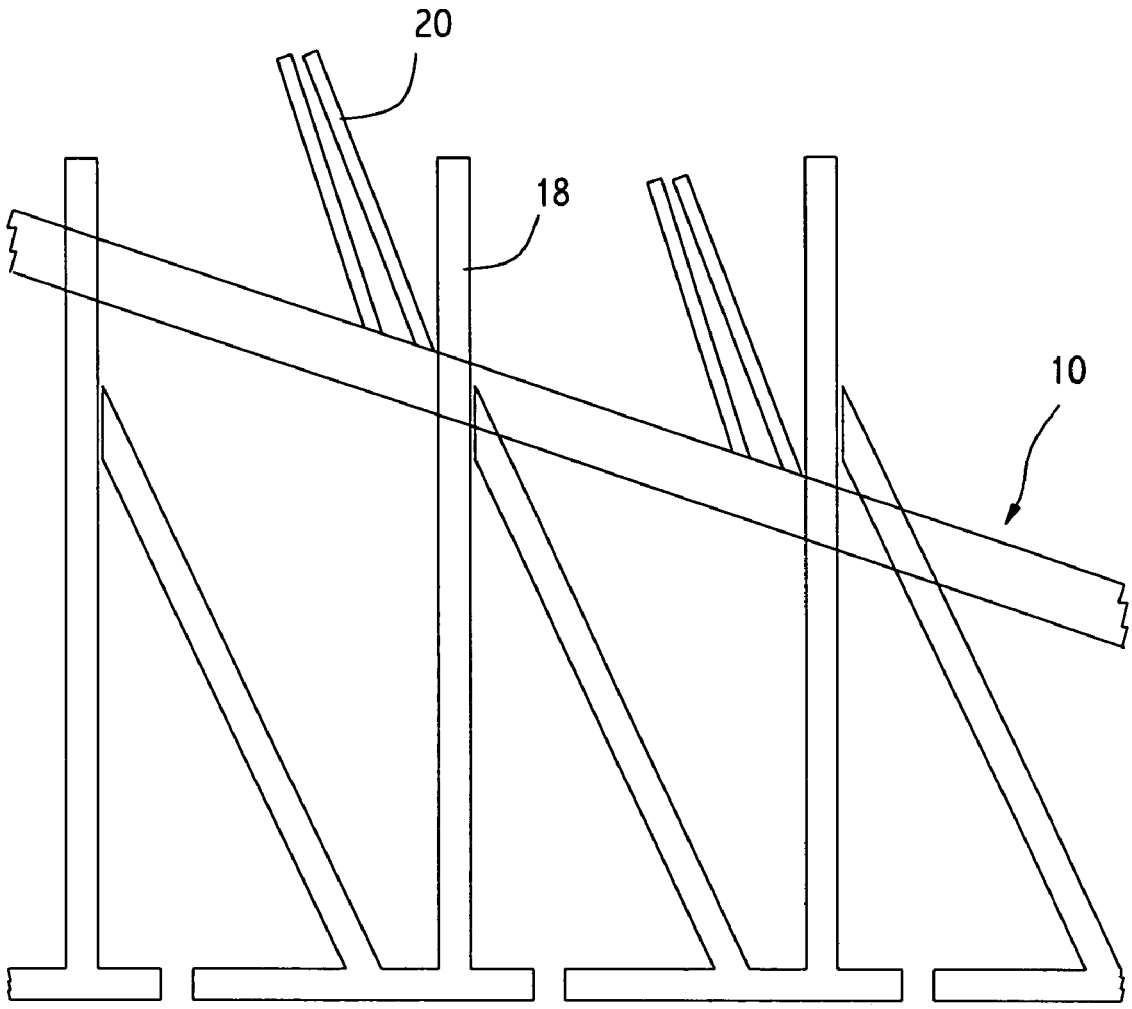
FIG. 12 shows a side view of the jacket conveyor in accordance with one embodiment of the present invention.
Figure 13:
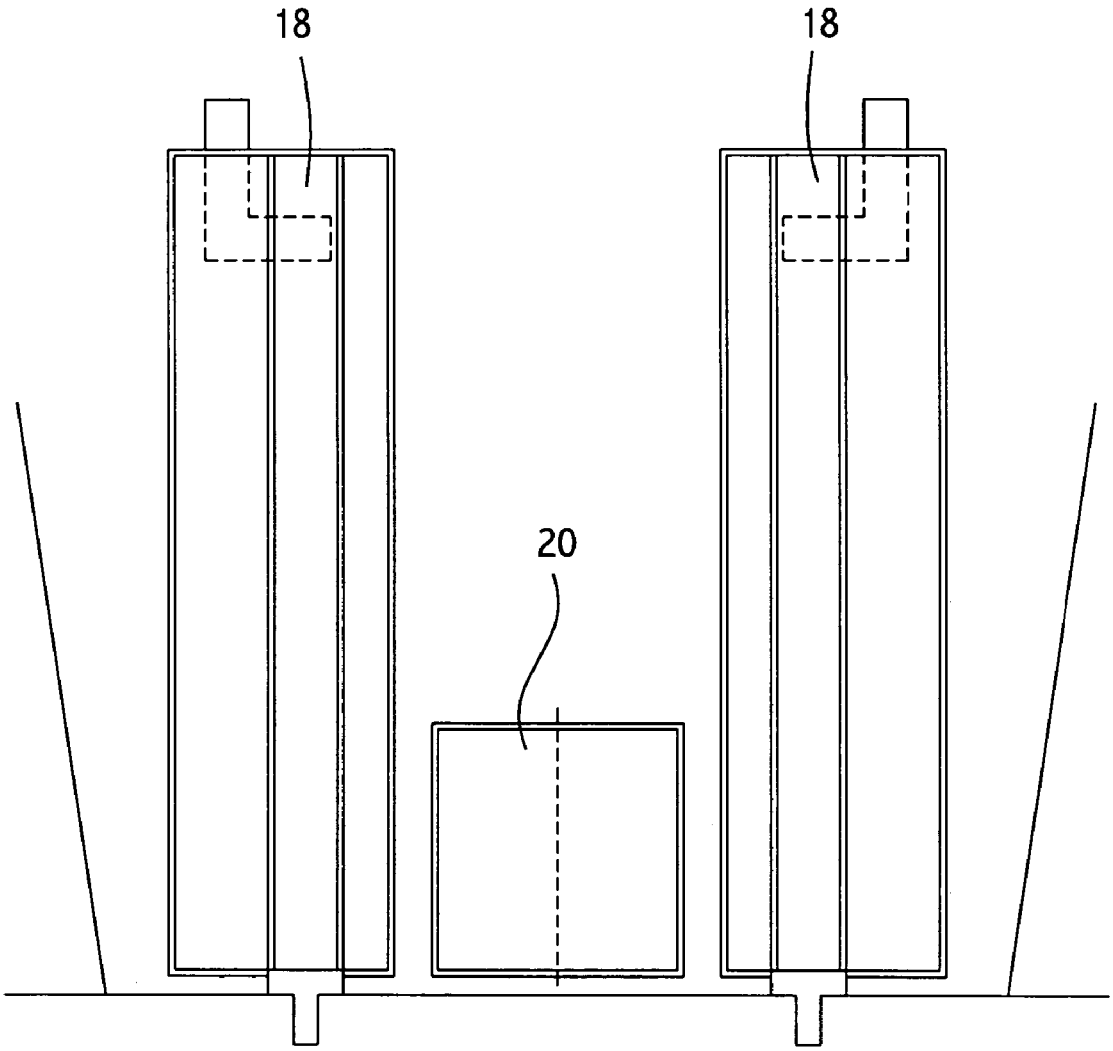
FIG. 13 shows a front view of the jacket conveyor in accordance with one embodiment of the present invention.
Figure 14:
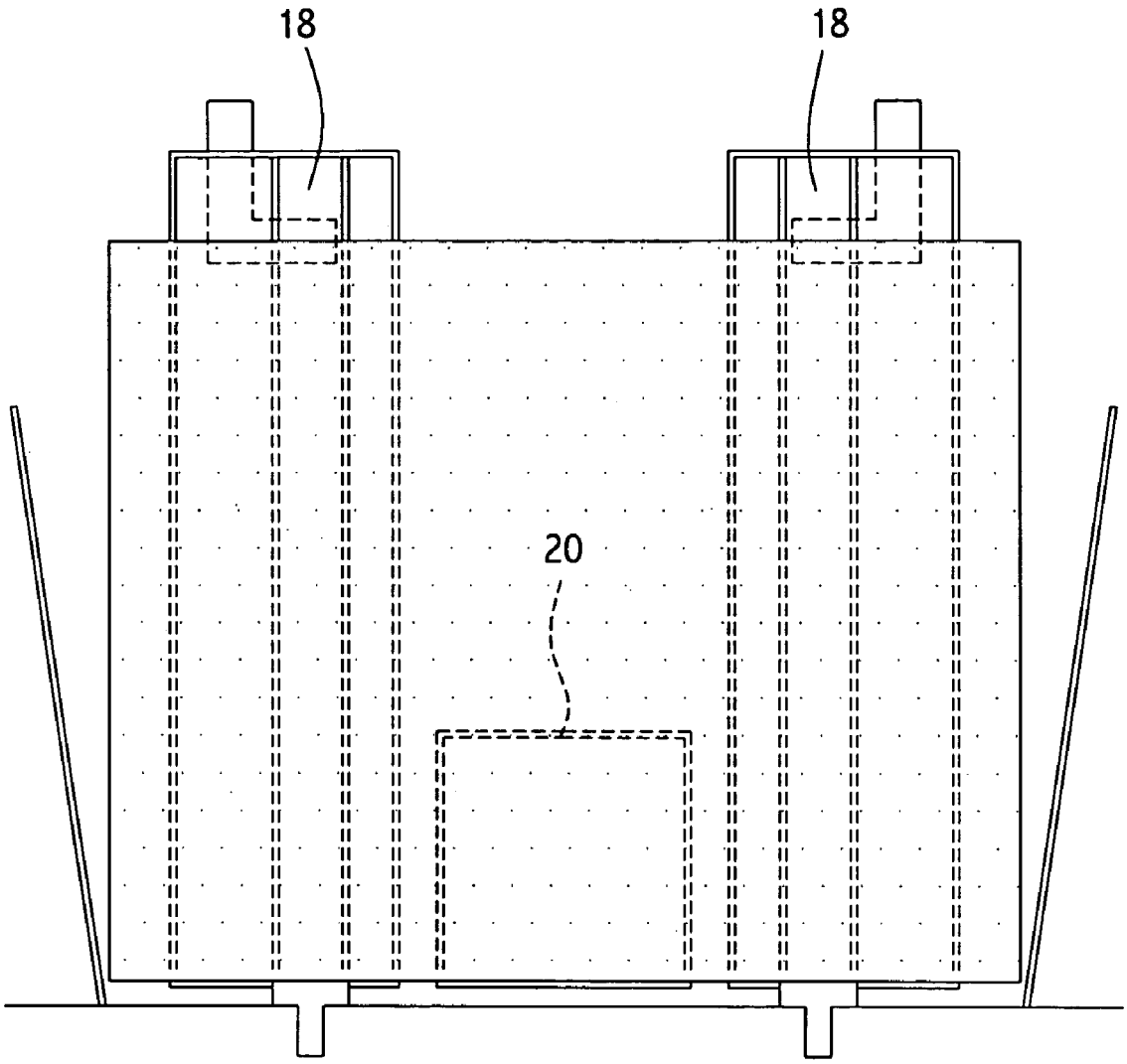
FIG. 14 shows a front view of the jacket conveyor with a jacket in place in accordance with one embodiment of the present invention.
Figure 15:
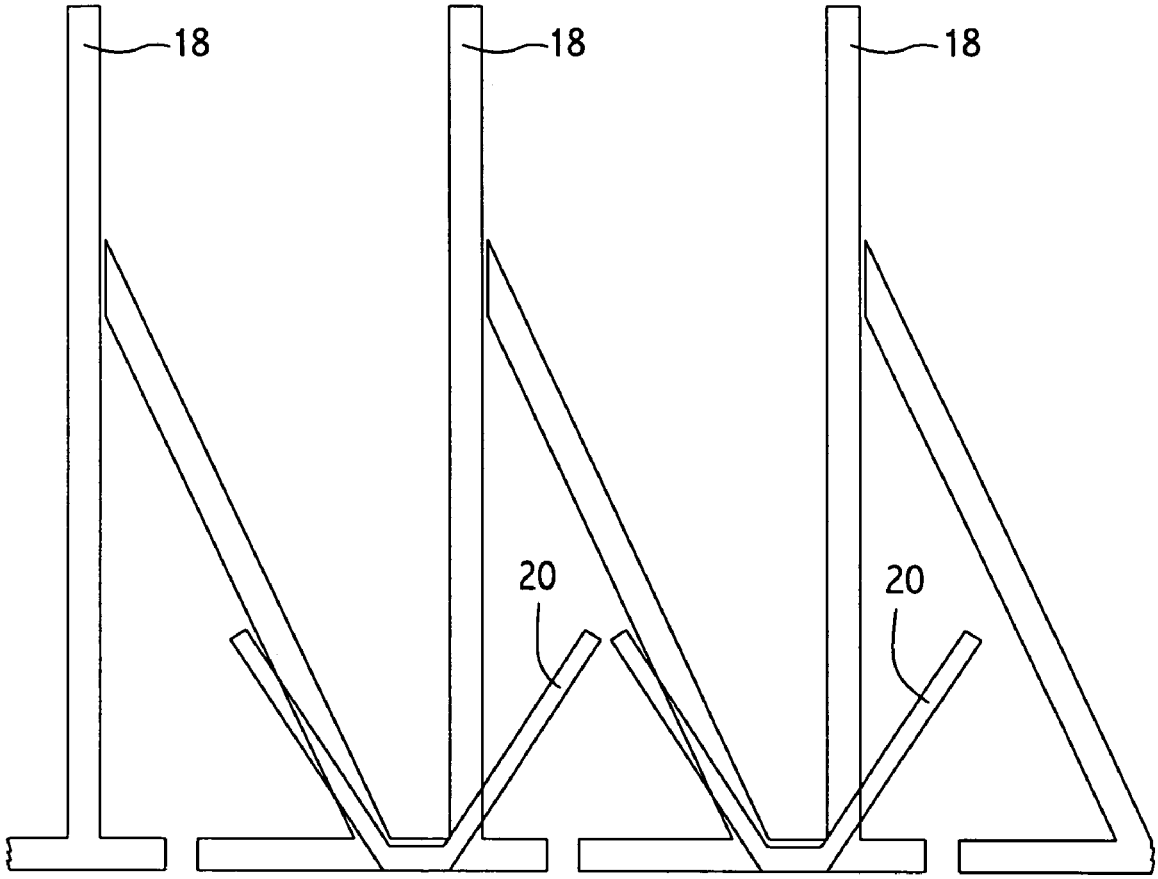
FIG. 15 shows a side view of the jacket conveyor with the gripper in the open position in accordance with one embodiment of the present invention.
Figure 16:
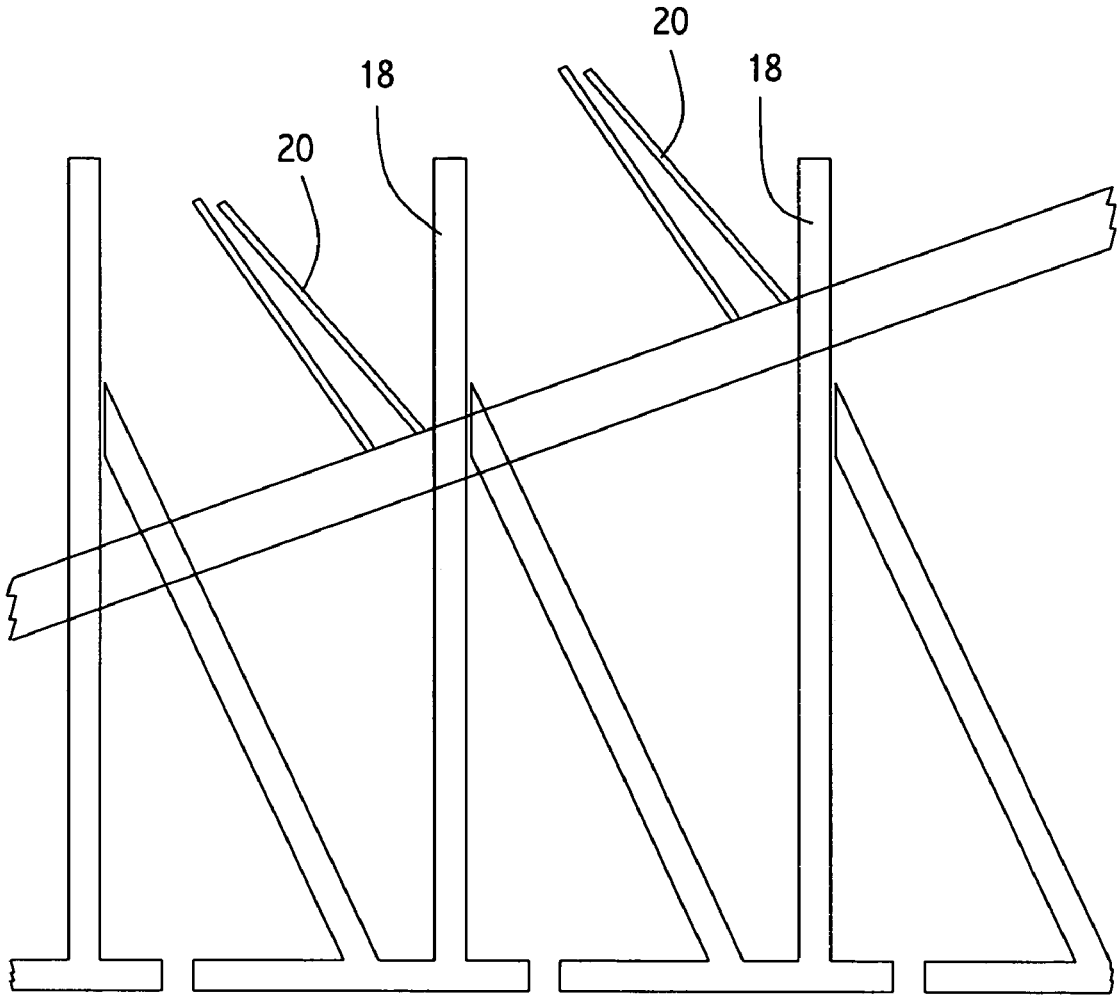
FIG. 16 shows a side view of the jacket conveyor in accordance with one embodiment of the present invention.

FIGS. 12 and 16 show a side views of the jacket conveyor being formed and separated respectively. In each of these views, the gripper conveyor 10 with its grippers 20 is threaded in between each post conveyor with its posts 18. FIG. 15 shows a side view of the completed jacket conveyor with an open gripper 20 and open post support 18. FIGS. 13 and 14 show frontal views of the gripper conveyor with and without a jacket 22. These views show the position of the gripper 20 in between the post support 18 when the gripper conveyor is formed.

In some embodiments, the present invention is capable of producing up to 75,000 completed jackets w/inserts per hour. Additionally, it should be understood that while newspapers have been shown in the various embodiments, the term "jackets" could be used to define any type of printed material such as magazines, tabloid newspapers, etc. that would use inserts. The present invention would work with any such printed media that need an insert.

Advantages of the present invention may include: receiving the jacket directly into the gripper from the press feeder; stabilizing the position of the jacket with the post support; having the gripper located inside and acting in conjunction with the post support; using the gripper to support and carry the jackets from underneath; and automatically carrying repairs back through the system.

While the invention has been described with respect to a limited number of embodiments, those skilled in the art, having benefit of this disclosure, will appreciate that other embodiments can be devised which do not depart from the scope of the invention as disclosed here. Accordingly, the scope of the invention should be limited only by the attached claims.

What is claimed is:

1. A method for adding inserts to printed material, comprising:

receiving a jacket that is closed in a jacket conveyor, where the jacket conveyor comprises, a gripper conveyor with a gripper;

a left post conveyor with a plurality of support posts, a right post conveyor with a plurality of support posts, and where the gripper conveyor, left post conveyor, and right post conveyor come together with each other to form the jacket conveyor at the beginning of a jacket conveyor line and where the jacket conveyor separates at the end of the jacket conveyor line by laterally rotating the left post conveyor and the right post conveyor on separate tracks in opposite directions away from each other to return to the beginning of the jacket conveyor line to reform the jacket conveyor;

receiving an insert into the jacket from an insert feeder;

closing the support posts against the jacket and then opening up the jacket with a plurality suction cups;

delivering the jacket and insert to a product receiver; and returning a jacket with an insert error to the jacket conveyor for correction of the insert error.

2. The method of claim 1, where the gripper conveyor delivers the jacket and insert to the product receiver.

3. The method of claim 2, where the gripper conveyor holds the jacket from below while delivering the jacket and insert.

4. The method of claim 1, where the product receiver is a jacket stacker.

5. The method of claim 1, where the gripper conveyor returns the jacket with an insert error to the jacket conveyor.

6. The method of claim 1, where the jacket comprises a newspaper.

7. An apparatus for adding inserts to printed material, comprising:

a jacket feeder;

a jacket conveyor that receives jackets that are closed from the jacket feeder, comprising, a gripper conveyor with a plurality of grippers, where the grippers support the jackets from the bottom, a left post support conveyor with a plurality of post supports, a right post support conveyor with a plurality of post supports, and where the gripper conveyor, left post support conveyor, and right post support conveyor form the jacket conveyor at the beginning of a jacket conveyor line and separate at the end of the jacket conveyor line along separate tracks that laterally rotate the left post conveyor and the right post conveyor in opposite directions away from each other and return to the beginning of the jacket conveyor line to reform the jacket conveyor; and a plurality suction cups that open and close the jackets against the post supports;

an insert feeder that feeds inserts into the jackets that are held open with suction cups; and a product receiver that receives jackets with inserts from the jacket conveyor.

8. The apparatus of claim 7, where the gripper conveyor delivers the jackets with inserts to the product receiver.

9. The apparatus of claim 7, where the gripper conveyor returns a jacket with an error to the jacket conveyor.

10. The apparatus of claim 7, where the jackets are newspapers.

* * * * *